US005926984A

United States Patent [19]

Zuber

[11] Patent Number: 5,926,984

[45] Date of Patent: Jul. 27, 1999

[54] EASILY SELECTIVELY ATTACHABLE AND REMOVABLE IRON REST, FORMING AN ACCESSORY FOR AN IRONING BOARD, ESPECIALLY FOR A POTENTIALLY HOT FLAT IRON

[75] Inventor: Gerhard Zuber, Meckesheim, Germany

[73] Assignee: Leifheit AG, Nassau, Germany

[21] Appl. No.: 09/022,270

[22] Filed: Feb. 11, 1998

[30] Foreign Application Priority Data

Feb. 13, 1997 [EP] European Pat. Off. ..... 97102291
Feb. 17, 1997 [DE] Germany ..... 197 06 165.6

[51] Int. Cl.[6] ..... D06F 79/02; D06F 81/00

[52] U.S. Cl. ..... 38/107; 38/142

[58] Field of Search ..... 38/103, 104, 106, 38/111, 135, 137, 141, 107, 142

[56] References Cited

U.S. PATENT DOCUMENTS

| | | | |
|---|---|---|---|
| 990,586 | 4/1911 | Perry | 38/107 X |
| 1,656,320 | 1/1928 | Crowder . | |
| 1,692,599 | 11/1928 | Wenzel . | |
| 1,903,601 | 4/1933 | Smolko . | |
| 2,139,809 | 12/1938 | Dolge | 38/107 |
| 2,194,224 | 3/1940 | Hauck | 38/142 |
| 2,482,957 | 9/1949 | Willens . | |
| 2,912,201 | 11/1959 | Lidums . | |
| 2,912,775 | 11/1959 | Gettelman . | |
| 3,082,986 | 3/1963 | Campanizzi . | |
| 3,202,389 | 8/1965 | Zoffer . | |
| 4,918,845 | 4/1990 | Livecchi . | |
| 5,142,802 | 9/1992 | Krause | 38/142 X |

FOREIGN PATENT DOCUMENTS

| | | | |
|---|---|---|---|
| 86 05 722 U | 6/1986 | Germany . | |
| M 96 01 268 | 9/1996 | Germany . | |
| 195 26 637 A1 | 1/1997 | Germany . | |
| 87 954 | 11/1920 | Switzerland . | |
| 742670 | 4/1954 | United Kingdom | 38/107 |

OTHER PUBLICATIONS

Zabar's, Leifheit Dressfix Ironing Board, 1998.

Leifheit, Hassen Sie Hemdenbügeln, undated.

*Primary Examiner*—Ismael Izaguirre
*Attorney, Agent, or Firm*—Frishauf, Holtz, Goodman, Langer & Chick, P.C.

[57] ABSTRACT

To permit easy attachment, removal, and repositioning of a rest plate of a potentially hot flat iron on an ironing board (1, 31), forming an accessory element, the iron rest plate (4, 37) is placed above the ironing board, which typically includes a padding (34, 35). The attachment to the board is by a cam or eccenter clamp (3, 36) which has a portion (6, 39) extending and projecting beneath a rim of the ironing board (1, 31), and essentially partly in alignment with the iron rest plate above the ironing board. The accessory is U-shaped, with the iron rest plate (4, 37) above the ironing board, a connecting carrier portion (38) essentially at the base of the U, and a clamping portion extending beneath the ironing board and beyond the edge thereof, which typically is a channel or similar construction projecting downwardly from the plane of the ironing board. The clamping portion reaches behind this edge and thus, essentially, is in part-alignment with the iron rest plate (4, 37). The connecting portion may be made of plastic, and have integrated therewith an electrical outlet or receptacle or socket; an electrical iron cable guide can be selectively positioned on either side of the accessory, so that it is user-friendly both for right-handed as well as left-handed users.

20 Claims, 3 Drawing Sheets

EASILY SELECTIVELY ATTACHABLE AND REMOVABLE IRON REST, FORMING AN ACCESSORY FOR AN IRONING BOARD, ESPECIALLY FOR A POTENTIALLY HOT FLAT IRON

Reference to related application and patents, the disclosures of which are hereby incorporated by reference:

U.S. Ser. No. 09/922,271, filed Feb. 11, 1998, Zuber

U.S. Pat. No. 1,692,599, Wenzel

U.S. Pat. No. 2,482,957, Willens

U.S. Pat. No. 2,912,775, Gettelman

U.S. Pat. No. 3,202,389, Zoffer

U.S. Pat. No. 4,918,845, Livecchi

Reference to related patent disclosures:

German 195 26 637 A1, Schülein et al.

German G 86 05 722.7 U1

German Design Model M 96 01 268.

FIELD OF THE INVENTION

The present invention relates to a flat-iron rest, as an accessory for an ironing board, suitable selectively, for use with an ironing board which has a downwardly projecting rim structure and more particularly to a rest or support for a potentially hot flat iron, in which the accessory is easily attachable and removable from the ironing board or ironing table by a clamping arrangement; the clamping arrangement includes a clamping element which provides a clamping force and interlocks with the ironing board or ironing table inwardly of the rim structure.

BACKGROUND

Clamps using screw clamping arrangements similar to C-clamps are known, in order to attach rests or support plates for flat irons on the frame of an ironing board. Such screw-type clamps do not permit rapid change or repositioning of the accessory plate, nor quick removal thereof, for example for storage of the ironing board as such. Such attachments permit reduction of the overall size of the ironing board, for example for transport, so that the accessory can be separately packed, sold or shipped. After connecting the accessory with the ironing board by tightening the screw clamp, there was no intention for routinely releasing the attachment, for removal, or repositioning, e.g. to accomodate right-handed or left-handed users, respectively.

It has also been proposed to locate an ironing rest for an ironing board by using a spring clamp which engages the ironing board. Such a clamp, for reliably holding the iron rest, must snap behind the frame of the ironing board. Since, usually, ironing boards have rims with enlarged edge structures which may be formed as channels or the like, it is difficult to remove such attachments, or re-attach them, since the spring must snap over an enlarged rim of the ironing board.

Frequently, attachment arrangements to rest an iron, which may still be hot, may also include electrical receptacles or sockets or the like (see, for example, German 195 26 637 A1, Schülein et al., assigned to the assignee of the present application). Usually, such attachment arrangements which include electrical connections are securely attached to the ironing board. The electrical socket arrangement, which may include also a holder for the electrical cord of the flat iron, can be secured to the ironing board by a frame attached to the iron rest which, in turn, can be attached to the ironing board.

German Utility Model G 86 05 722.7 U1 describes an arrangement in which the ironing board has a support body located at an end portion of the ironing board which can be pivoted from a horizontal position extending away from the ironing board to a deflected position over the ironing board.

Prior art clamping arrangements, which permit removal of the accessory plate, are usually difficult to handle. The accessory elements, frequently, project beyond the ironing board, causing substantial torques to be applied on the clamping element. The padding which is usually applied to the upper side of the ironing board further interferes with good force transmission. Only a relatively small frame around the edge of the ironing board, usually rectangular or square, is available for connection. The geometric relationships of the elements available to attach such accessory elements are unsuitable for a reliable positioning of an accessory, capable of handling a potentially heavy flat iron.

The Invention

It is an object to provide an accessory element, and more particularly flat iron rest or support plate iron support structure for use with an ironing board, which can be easily attached, or released or, respectively, repositioned at any desired location on the ironing board; and, further, which permits locating the accessory iron rest plate at positions on the ironing board suitable both for right-handed as well as left-handed persons. Additionally, the attachment or accessory element should be so arranged that it does not interfere with, or complicate, transport of the ironing board, either for shipment or for storage, for example within a home.

Briefly, the accessory or attachment arrangement has a support plate adapted to be located above the ironing board padding, and to receive a flat iron, which may be potentially hot. A clamping element in form of a cam, or an eccenter couples the support plate to the ironing board for selectively clamping the clamping plate against the underside of the ironing board. The underside of the ironing board, of course, usually is not padded and may be solid, typically perforated, a grid structure, or the like, surrounded by a rim structure, capable of accepting a clamping force.

The arrangement has the advantage that the clamping element can engage behind a rim structure, or frame of the ironing board against an essentially flat structure. By engaging a portion of the accessory against the frame and edge of the frame of the ironing board, and clamping behind the frame, an interlocking connection, as well as a force clamped connection is obtained between the support plate of the accessory element with the ironing board. This provides for reliable and stable positioning and retention of the accessory on the ironing board, and over the usual padding thereof. The clamping arrangement preferably has lever action.

In a preferred simple form, the lever is a two-arm lever which has a comparatively long positioning or clamping movement so that it can be easily operated without application of much force. A spring provides for retention of the lever in clamped condition. The spring, preferably, is so arranged that, upon removal of the accessory, the removal movement of the operating arm of the lever further tensions the spring, while permitting a locking or cam portion of the clamping lever to pivot parallel to the major surface or ironing surface of the ironing board.

In accordance with another preferred embodiment of the invention, and to reduce the clamping forces required, the clamping element has an eccenter or cam or similar structure, in order to reliably retain the accessory element against the ironing board table. The engagement of the iron support surface against the ironing board is somewhat resilient because of the padding on ironing boards. This resiliency is not detrimental. The attachment, which can be easily clamped, or released by the clamping element, can be readily repositioned or removed, in accordance with the size of items to be ironed, or other requirements. The support surface for the iron does not extend beyond the surface of the ironing board, so that the ironing board, with the accessory in place, permits ready storage of the ironing board even in crowded spaces in a home; likewise, shipping of the ironing with the attachment hardly increases the size of shipping cartons required.

Forming the clamping element as a cam permits particularly rapid attachment and release, while still ensuring reliable holding and affixing of the accessory to the ironing board. The engagement force point or, rather, line or surface of the clamping element is located behind the rim or edge frame of the ironing board and thus under, and in alignment with, the iron support plate.

The attachment element may be made of several portions, at least one of which, and particularly a connecting carrier or support portion for the accessory element connecting the rest plate and the counter element, can be made of plastic. This permits substantial freedom for the design of the accessory element, as well as of further attachment structures. For example, a cable guide for the connecting cable of an electric iron, or for external connections, can be so arranged that it is easily repositionable to be convenient for right-handed as well as left-handed users; clothes support rods likewise can be attached thereon. An electrical receptacle or socket can be completely integrated in this portion; it is also possible to so form the carrier portion of the accessory element to directly include the external portions of an electrical receptacle.

The carrier portion can be so constructed that a cable can be wrapped about guide elements thereof, so that loose wires will not dangle from the ironing board, but can be neatly wrapped, which improves the safety of handling of the ironing board, both for storage as well as when in use.

DRAWINGS

DETAILED DESCRIPTION

Figure 1:
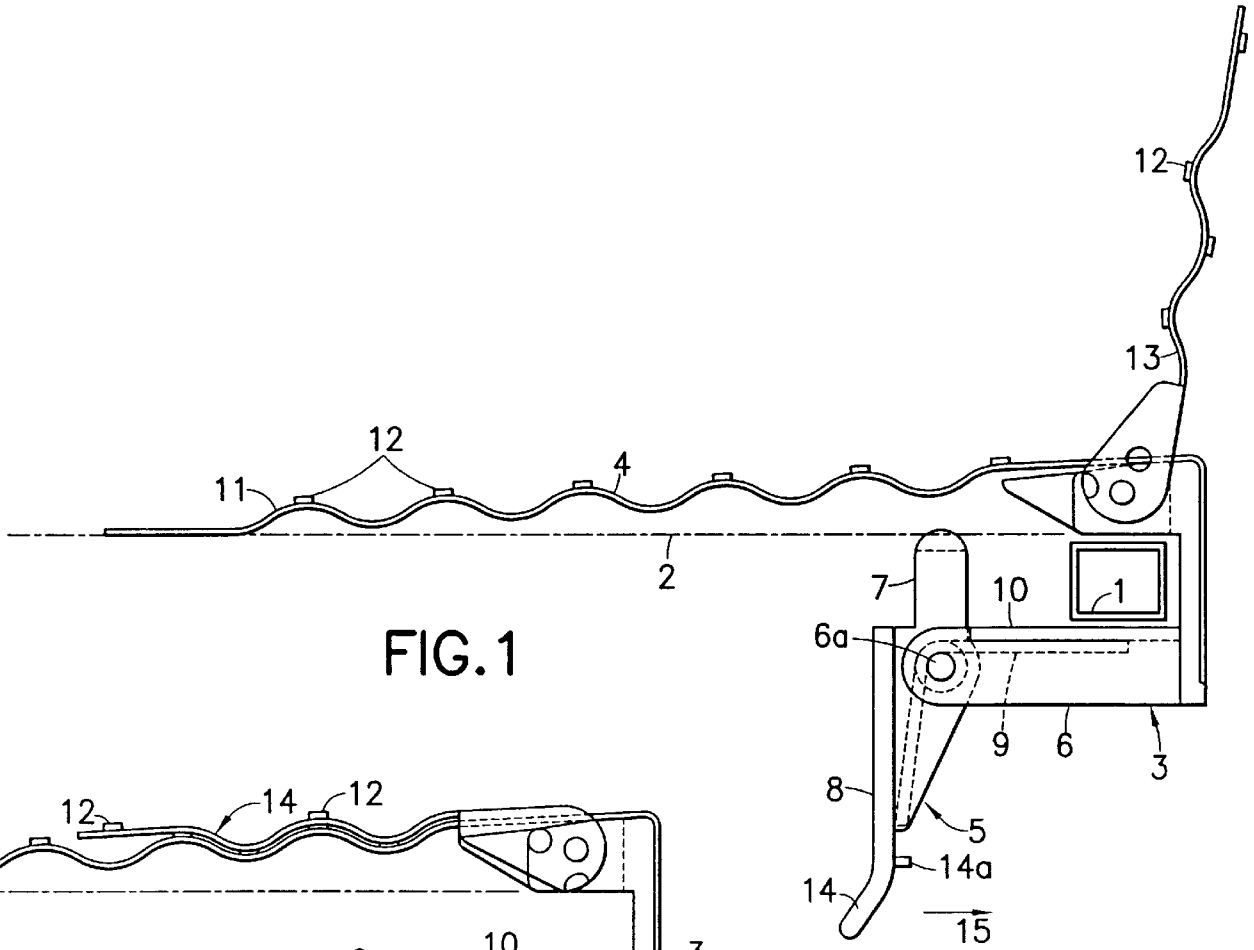
FIG. 1 is a highly schematic side view of an iron rest, forming an ironing board accessory element, with an ironing board accessory plate shown in position on an ironing board which is only schematically indicated by a chain-dotted line.

Referring first to FIG. 1:

An ironing board, shown only highly schematically, has a frame 1 from which an ironing board plate or surface 2 extends. Typically, the surface 2 is covered on the top by a padding and a heat-resistant ironing board cover. A clamping arrangement 3 clamps an iron support or rest plate 4 of the iron rest to the ironing board by a clamping lever 5.

The clamping arrangement 3 which, in general, is U-shaped and horizontally applied on the ironing board, is suitably dimensioned to fit around and beyond the frame 1. A leg 6, of the clamping arrangement 3, projects over a distance substantially behind the frame 1. The projecting leg 6 carries a journal or bearing **6*a* at its end. The bearing pivotably receives the locking lever 5 to permit simple locking of the iron rest by camming action. The locking lever 5 is a double-arm lever which has a locking arm 7 functioning as a cam, and an operating arm 8. A spring 9 having two projecting ends is engaged against a wall 10 of the leg 6 of the arrangement 3 to hold the locking lever 5 in the engaged clamping position shown in FIG. 1. The locked positioning arm 7 engages against the underside of the ironing board plate 2, see FIG. 1**.

The support or iron rest plate 4 is corrugated or undulated, as shown, and the raised portions 11 thereof have silicone strips 12 thereon to ensure that an iron placed on the support plate 4 will not slip or slide.

Figure 2:
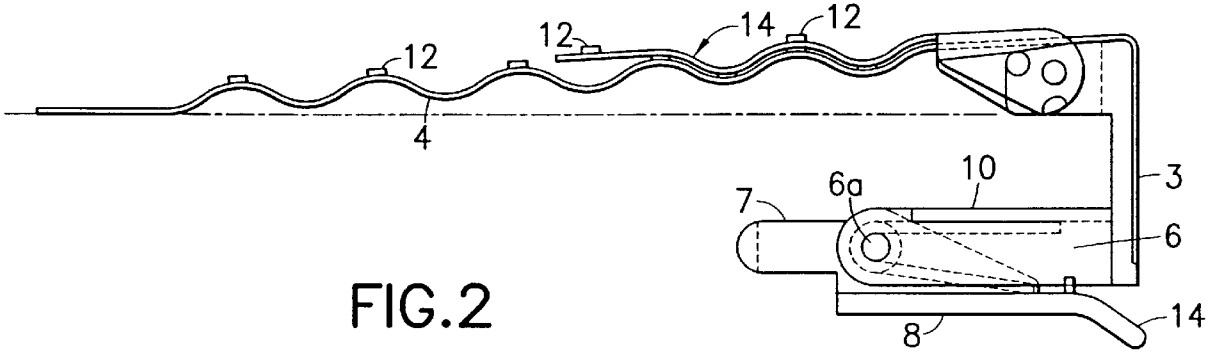
FIG. 2 illustrates the position of the attachment or accessory element when it is to be released from the ironing board.

A positioning arrangement, for example in form of a tiltable reception element 13 also having silicone strips, is connected to the arrangement 3. In the position shown in FIG. 1, it can be used as a support element for a steam iron; if not so needed, it can be pivoted to fit against the plate 4, as shown in FIG. 2. Silicone strips 12 are preferably provided on both sides of the reception element 13.

If it desired to remove the accessory element or arrangement 3, for example for repositioning at another side of the table if the user so desires, for example for ironing of smaller portions, or for repositioning from a right-handed to a left-handed user or the like, or if a separate placement or storage is desired, it is only necessary to slightly pull on the lever 8, which at its end is formed with an operating grip 14, and move the element counter the force of the spring 9. This locks the clamping arm 7 in horizontal position (see FIG. 2), and permits lateral removal of the entire arrangement 3 in horizontal direction. It is only necessary to pull off the arrangement 3 in the direction of the arrow 15 (FIG. 1). A small projection **14*a* on lever 14 can engage in a matching hole, for example of keyhole shape, to secure the lever 14 in the position shown in FIG. 2**.

No special instructions to the user for connection or removal are needed. Operation is obvious, and automatically correct for placement, positioning or removal.

FIGS. 3 to 6 illustrate another preferred embodiment of the present invention, which is particularly easy to operate from a side of the board and, further, provides a storage space for an electrical cable.

The ironing board 31 has a rim frame 32 in channel construction. An ironing board table 33, generally in plate form, and preferably made of expanded metal, is covered, typically, by an ironing board cover padding 34 which, in turn, is covered by a heat resistant cover 35. The iron rest, as an accessory or attachment element 36 is attachable to this ironing board 31, as well as of course to the ironing board shown in FIG. 1. The accessory 36, in longitudinal cross section, is essentially U-shaped.

The accessory 36, essentially, has an iron rest plate 37 fitting against the top of the ironing board 35. The accessory 36 further includes a connecting or carrier portion 38 located, when installed at the side of the ironing board (see FIG. 3). The carrier portion 38 also has a subportion 40 formed to provide a receptacle 41 for an electrical connecting plug. Left and right retention plugs, projections or pins 42, 43 permit, selectively, attachment of an electrical wiring cable guide 44, either at the left or right side of a connecting carrier portion 38. The cable guide 44 is intended to keep an electrical connecting cable to an electrical flat iron out of the way. The connecting carrier 38 likewise has provisions to retain a bearing shaft 45 for retention of the clamping element. The subportion unit 40 and the shaft 45, in the present case, are identical.

The clamping element 39 has a sleeve 46 (FIG. 5) forming a bearing sleeve; a guide sleeve 47 and a clamping eccenter 48, e.g. in the form of a cam (FIG. 5) projeting from the guide sleeve 47, are rotatably retained in carrier portion 38. An operating lever 49 is coupled to the sleeve 46.

Figure 3:
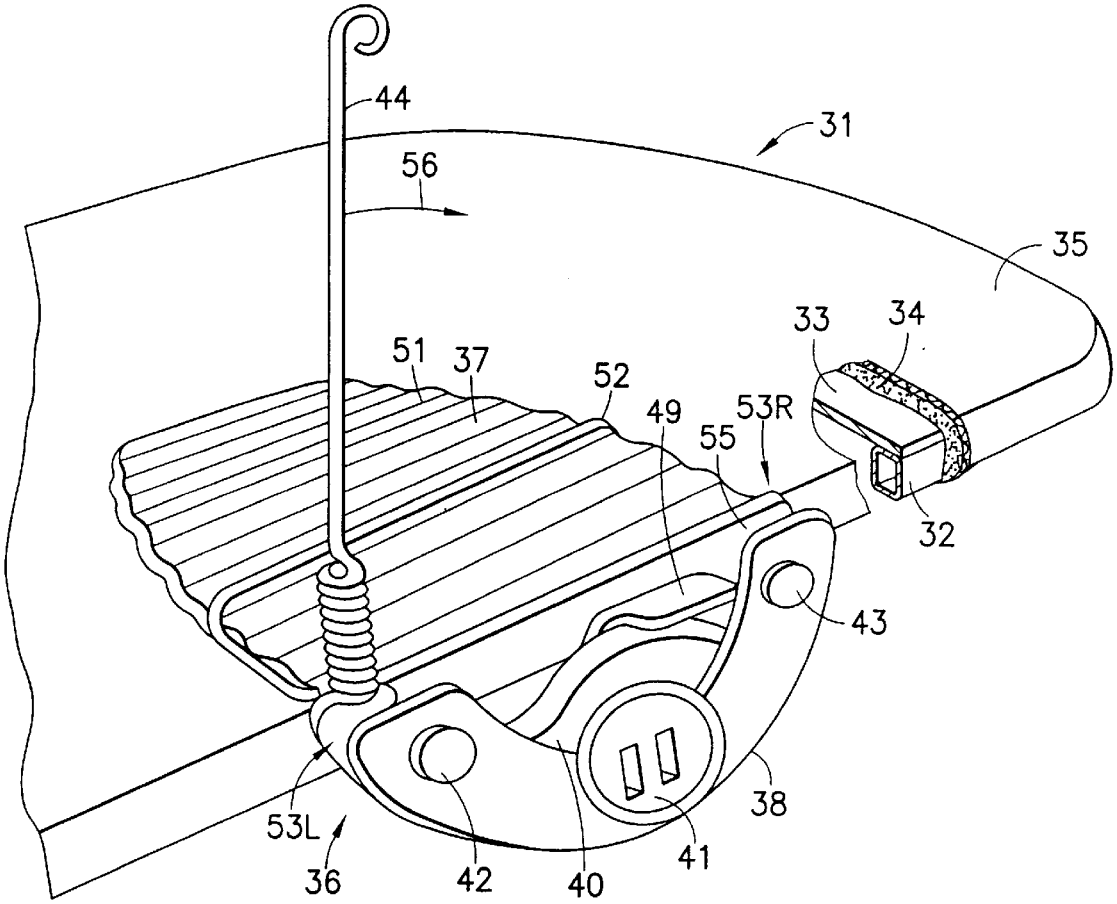
FIG. 3 is a perspective view of another embodiment of the accessory or attachment element on a portion of an ironing board, in which the ironing board is shown partly broken away.
Figure 4:
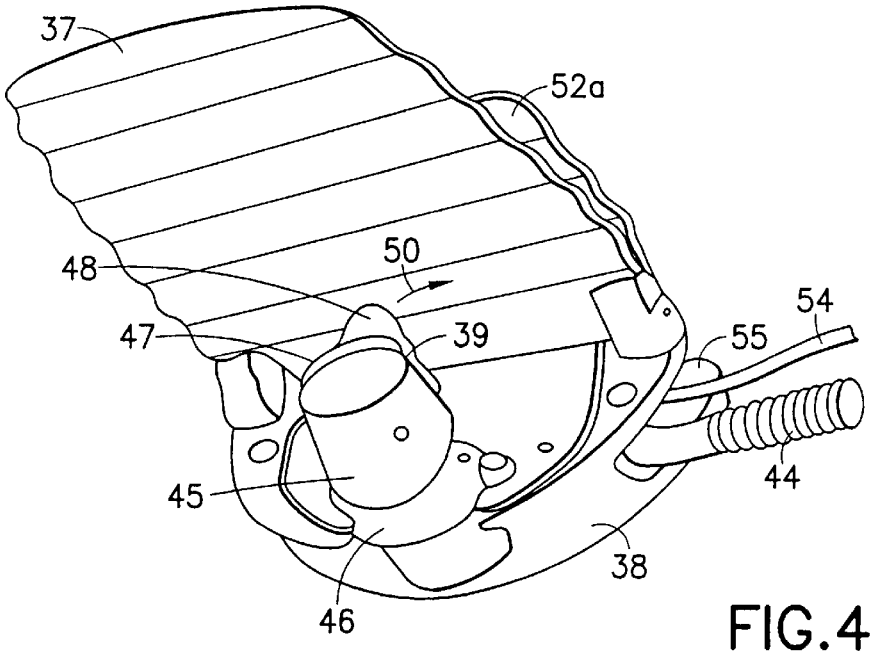
FIG. 4 is a bottom view, from below, of the attachment arrangement, with the ironing board removed.
Figure 5:
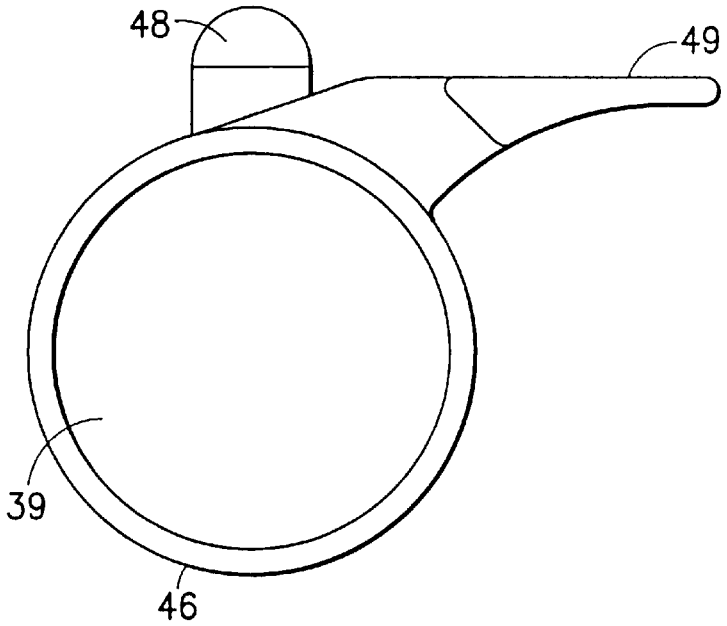
FIG. 5 is a front view of the clamping arrangement of the accessory of FIG. 3.

FIGS. 3 and 4 show the clamping cam 48 in closed or locked condition, which provides a clamping force and interlocked connection between the rest plate 37 and the bottom of the ironing board 31 in a line or surface engagement. Upon pivoting the lever 49 towards the left, the clamping cam 48 moves in the direction of the arrow 50 (FIG. 4) and the releases the path to remove the accessory 36.

The rest plate 51 for the flat iron, which may be hot, is preferably corrugated as shown. Preferably, it can be constructed as best seen in FIG. 3 with an upwardly movable frame element 52 or, as shown in FIG. 4, with an upwardly movable, tiltable corrugated or undulating plate element 52*a,* similar to plate 13 of FIG. 1. This permits a steam iron (not shown) to be rested on the plate 51 in an inclined position.

The connecting carrier portion 36 can be constructed in double-wall form at both end regions 53R and 53L. The pins or projections or plugs 42, 43, extending between the two walls of the connecting portion 36, permit repositioning the cable guide 44. The cable guide 44 can also be pivoted downwardly in the direction of the arrow 56 (FIG. 3). FIG. 4 shows the cable guide 44 pivoted horizontally, for example for storage, leaving the space 55 for storage of a cable 54. The double-wall construction of the connecting carrier portion 38 provides space 55 to wrap an electrical cable, connected to the outlet or receptacle 41, around the connecting element 38 and secure it in the slot between the two walls of the connecting element 36.

Figure 6:
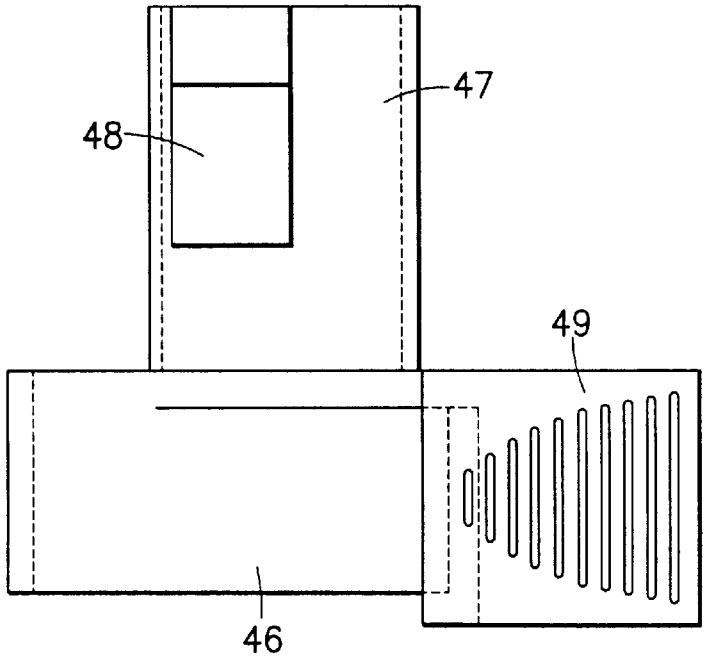
FIG. 6 is a top view of the clamping arrangement of the accessory of FIG. 3.

As best seen in FIG. 6, the longitudinally extended cam 48 provides a good, extended engagement surface against the bottom of the ironing board plate 33, beyond the rim or edge channel 32.

Various changes and modifications may be made and any features described herein in connection with any one of the embodiments can be used with any of the others, within the scope of the inventive concept.

I claim:

1. Easily selectively attachable and repositionable flat iron rest, forming an accessory for an ironing board (2, 31), and selectively suitable for use with an ironing board which has a rim frame (1, 32), comprising:

a support or rest plate (4, 37) for a potentially hot flat iron, said support or rest plate (4, 37) being adapted to be placed above the ironing board, optionally above an ironing board padding (2, 34, 35), when said flat iron rest is installed on the ironing board (2, 31);

a clamping element (3, 36) having a portion (6, 39) extending and projecting beneath the ironing board, said extending and projecting portion including a locking cam or eccenter (7, 48), said cam or eccenter (7, 48) being located beyond and inwardly of said rim frame (1, 32), when said flat iron rest is installed on an ironing board having said rim frame, said extending or projecting portion, and said cam or eccenter being located, at least in part, underneath and in alignment with said iron rest plate and inwardly of the edge or rim frame (1, 32) of said ironing board, and selectively clamping said clamping element (3, 36) against the underside of the ironing board.

2. The accessory of claim 1, further including a tiltable iron rest element (13, 52, 52*a*) pivotably coupled to said iron rest plate (4, 37) and shaped to, selectively, snugly fit against said iron rest plate (4, 37).

3. The accessory of claim 1, wherein said clamping element comprises:

a locking lever (49) coupled to said cam or eccenter (7, 48); and a leg spring (9) is provided, retaining said locking lever (5) in locked position.

4. The accessory of claim 3, wherein said locking lever (5) comprises a double-arm lever having a locking arm and an operating arm (8), said locking arm forming said cam (7).

5. The accessory of claim 1, wherein said iron rest plate (4) comprises a plate structure shaped and equipped for reception of a potentially hot flat iron.

6. The accessory of claim 5, wherein said iron rest plate (4, 37) comprises an undulating or corrugated plate, and non-slip, heat-resistant material (12) located, at least in spot, button, or strip form, on projecting portions of said rest plate, optionally silicone spots, buttons or strips.

7. The accessory of claim 1, wherein said iron rest plate (4, 37) and said clamping arrangement (3, 36), together, comprise an essentially, in cross section, U-shaped structure, overlapping the rim frame (32) of the ironing board (31), and a connecting carrier (38) forming the base or bottom of said U-shaped structure and connecting said rest plate (37), which forms one leg of the U, with said clamping element (36) which forms another leg of said U.

8. The accessory of claim 7, wherein said clamping element (36) comprises an eccenter (48), and an operating lever (49) coupled to said eccenter for rotation of said eccenter.

9. The accessory of claim 1, wherein said iron rest plate (4) comprises a plate structure shaped and equipped for reception of a potentially hot flat iron;

and wherein a tiltable element (13, 52*a*) is provided tiltable away from said rest plate (4), comprising a plate fitting against and matching at least in part the shape of said rest plate, but extending over only a portion of the length thereof.

10. The accessory of claim 9, wherein aid iron rest plate (4) and said tiltable element (13, 52*a*) have heat-resistant, slip-resistant strips, buttons, or spots thereon, positioned to be effective on said plate structure regardless of whether the tiltable element is fitted against the rest plate, or pivoted away therefrom.

11. The accessory of claim 7 further comprising a cable guide element (44), selectively positionable at either a right side or a left side of said connecting carrier (38) and, optionally, an electrical outlet or socket or receptacle (41) on said connecting carrier (38).

12. The accessory of claim 7, further comprising an electrical outlet or receptacle or socket (41) formed on a subportion (40) of said connecting carrier (38).

13. The accessory of claim 7, wherein said connecting carrier (38) includes an extending portion (39) forming a bearing shaft (45) for a clamping portion (39) of said clamping element (36).

14. The accessory of claim 12, wherein said connecting carrier supports an electrical outlet or receptacle or socket (41); and, optionally, an electrical cable is provided connected to said outlet or receptacle or socket (41).

15. The accessory of claim 7, wherein the iron rest plate (4, 37), said connecting carrier (38) and, optionally, an electrical outlet or receptacle or socket (41), comprises a unitary plastic element.

16. The accessory of claim 7, wherein said connecting portion (38) is a double-wall structure defining a gap (55) therebetween to provide a storage region for an electrical cable (54).

17. The accessory of claim 8, wherein, when said accessory is clamped to the ironing board, said connecting carrier (38) and the operating lever (49) for said eccenter (48) are located laterally of the ironing board (71).

18. The accessory of claim 8, wherein, when said accessory is clamped to the ironing board, said connecting carrier (38) is located laterally of the ironing board (71); and wherein said operating lever (49) is positioned on said connecting carrier (38) accessible laterally with respect to the ironing board.

19. The combination of an ironing board defining an ironing board surface (2, 31), which surface is surrounded by a rim frame (1, 32) and projecting downwardly, when said ironing board is placed in an ironing position, said ironing board, optionally, having an ironing board padding (2, 34, 35) located above the ironing board surface (2, 31), with a flat iron rest selectively attachable and repositionable on said ironing board, said flat iron rest comprising:

a support or rest plate (4, 37) adapted to be placed above said ironing board surface or, optionally, said ironing board padding (2, 34, 35); and a clamping element (3, 36) having a portion (6, 39) which includes a locking cam or eccenter (7, 48), extending and projecting beneath the ironing board surface (2, 31), said cam or eccenter being located inwardly of and beyond said rim frame (1, 32), said extending and projecting portion and said cam or eccenter being located at least in part underneath and in alignment with said iron rest plate (4), inwardly of the edge or rim frame (1, 32) of the ironing board, and selectively clamping said clamping element against the underside of the ironing board.

20. The combination of claim 19, wherein said iron rest plate (4, 37) and said clamping arrangement (3, 36), together, comprise an essentially, in cross section, U-shaped structure, overlapping the rim frame (32) of the ironing board (31);

a connecting carrier (38) forming the base or bottom of said U-shaped structure and connecting said rest plate (37), which forms one leg of the U, with said clamping element (36) which forms another leg of said U;

said clamping element (36) comprises an eccenter (48) extending, from said U-shaped structure inwardly beyond said rim frame (1, 32) and essentially in central alignment with said iron rest plate (4, 37);

and an operating lever (49) coupled to rotate said eccenter and positioned in said connecting carrier (38), accessible laterally with respect to the ironing board.

* * * * *